US007357841B2

(12) United States Patent
Puffe

(10) Patent No.: US 7,357,841 B2
(45) Date of Patent: Apr. 15, 2008

(54) APPLICATOR WITH SPRING-MOUNTED NOZZLE LIP

(75) Inventor: Wolfgang Puffe, Buchholz-Mendt (DE)

(73) Assignee: Nordson Corporation, Westlake, OH (US)

( * ) Notice: Subject to any disclaimer, the term of this patent is extended or adjusted under 35 U.S.C. 154(b) by 244 days.

(21) Appl. No.: 11/179,815

(22) Filed: Jul. 12, 2005

(65) Prior Publication Data

US 2006/0016391 A1 Jan. 26, 2006

(30) Foreign Application Priority Data

Jul. 15, 2004 (DE) ..... 10 2004 034 422

(51) Int. Cl.
*B05B 7/06* (2006.01)

(52) U.S. Cl. ..... 118/315; 118/325

(58) Field of Classification Search ..... 118/325, 118/315, 411; 425/192 S, 382.3, 382 R, 425/382.2; 222/410; 156/578; 239/581.1, 239/562

See application file for complete search history.

(56) References Cited

U.S. PATENT DOCUMENTS

| | | | | |
|---|---|---|---|---|
| 3,302,240 | A * | 2/1967 | Loos | 425/190 |
| 4,464,104 | A * | 8/1984 | Gneuss | 425/192 R |
| 6,960,261 | B2 | 11/2005 | Westermann | |
| 2003/0173429 | A1 * | 9/2003 | Puffe | 239/550 |
| 2005/0241575 | A1 * | 11/2005 | Schneider | 118/410 |

FOREIGN PATENT DOCUMENTS

DE 20216794 U1 4/2004

* cited by examiner

*Primary Examiner*—Brenda A. Lamb
(74) *Attorney, Agent, or Firm*—Wood, Herron & Evans, L.L.P.

(57) ABSTRACT

An applicator for applying liquid media to a material strip that can be moved relative to the applicator includes a housing having a drum chamber, a drum gate supported within the drum chamber and adapted to rotate therein, and a nozzle block spring-mounted to the housing. The nozzle block includes an inner surface communicating with the drum gate and a linear nozzle adapted to apply the liquid media to the material strip.

5 Claims, 4 Drawing Sheets

APPLICATOR WITH SPRING-MOUNTED NOZZLE LIP

This application claims the priority of German Application Serial No. DE 102004034422.1 filed on Jul. 15, 2004.

TECHNICAL FIELD

The invention pertains generally to an applicator for applying liquid media, for example, liquefied thermoplastic polymers or molten hot melt adhesives to a material strip that can be moved relative to the applicator.

BACKGROUND

An applicator for applying liquid is shown in DE 102 16 356 C1 (the DE '356 application). The DE '356 application discloses axially parallel surface grooves arranged on a drum gate. More specifically, the applicator respectively comprises first grooves that apply the liquid medium on the material strip in the form of a line that extends perpendicularly to the direction that the material strip moves, as well as second surface grooves for accommodating sealing lips that adjoin the surface of the drum chamber under prestress. One respective second surface groove is assigned to each first surface groove such that it trails the first surface groove during the rotation of the drum gate. This is intended to prevent liquid medium from continuing to flow into the supply lines leading to the linear nozzle from the gap between the drum gate and the drum chamber, the thickness of which lies on the order of 0.02 mm, after the first surface groove moves past said supply lines. This particular concept with second surface grooves for accommodating sealing lips cannot be used in connection with surface grooves that have a more complicated progression on the cylinder surface, e.g., in the form of a closed, continuous line.

SUMMARY OF THE INVENTION

Based on these circumstances, the invention aims to make available an applicator of the above-described type that ensures a highly selective application of liquid media on material strips. This objective is achieved in that the linear nozzle is positioned in a nozzle block that is spring-mounted to the housing and adjoins the drum gate under prestress. This ensures a gap-free contact in the region in which the liquid medium flows from the surface groove of the drum gate into the supply lines leading to the linear nozzle regardless of the aforementioned gap in the form of a cylinder jacket that is formed between the drum gate and the drum chamber, which must be provided in any case in order to compensate for different thermal expansions. Thus, a so-called reapplication is prevented after the surface groove moves past the linear nozzle, i.e., the medium is applied to the material strip in highly selective fashion with the shape and width of the surface groove in the drum gate. Clean boundaries of the applied liquid medium are also advantageous with respect to the additional processing of the material strip.

According to one advantageous embodiment, the inner cylindrical contact surface of the nozzle block on the drum gate is adapted to, or shaped to cooperate with, the cylindrical surface of the drum gate.

According to another advantageous embodiment, the drum gate comprises an inner cavity that can be a supplied with liquid medium, at least one surface channel that can be supplied with liquid medium from the inner cavity and is able to communicate with the linear nozzle as a function of the rotational position, and radial outlet bores that lead from the inner cavity into the at least one surface channel.

An applicator according to the invention provides the advantage that the nozzle block controls the medium with clean contours at the inlet openings to the supply lines leading to the linear nozzle such that the precision of metering the liquid medium is not disadvantageously influenced by the viscosity of the medium or the elasticity of the medium. Flawless application results can be obtained over the entire length of the applicator due to the defined supply of the liquid medium from the inner cavity of the drum gate to the linear nozzle.

According to a first embodiment, a transverse bore is provided in the housing on at least one end thereof, and an annular channel is arranged between the drum gate and the drum chamber and connected to the transverse bore in the housing. In addition, radial supply bores are arranged in the drum gate in the plane of the annular channel, wherein said supply bores are connected to the inner cavity and serve for supplying the respective medium. At least one annular channel or groove may also be provided in the drum surface and/or the periphery of the drum chamber.

According to an alternative embodiment, the drum gate is provided with at least one pin that axially protrudes from the housing and contains an axial bore that is connected to the inner cavity and serves for supplying the medium to the inner cavity. Although this results in a particularly simple design of the housing, it is necessary to provide a rotary seal in the region in which the pressurized medium is supplied to the pin.

In both above-described embodiments, it is necessary to provide a reliable seal between the housing and the surroundings as well as a peripheral seal between the nozzle block and the housing.

One preferred embodiment is illustrated in the figures and described below.

DETAILED DESCRIPTION

Figure 1A:
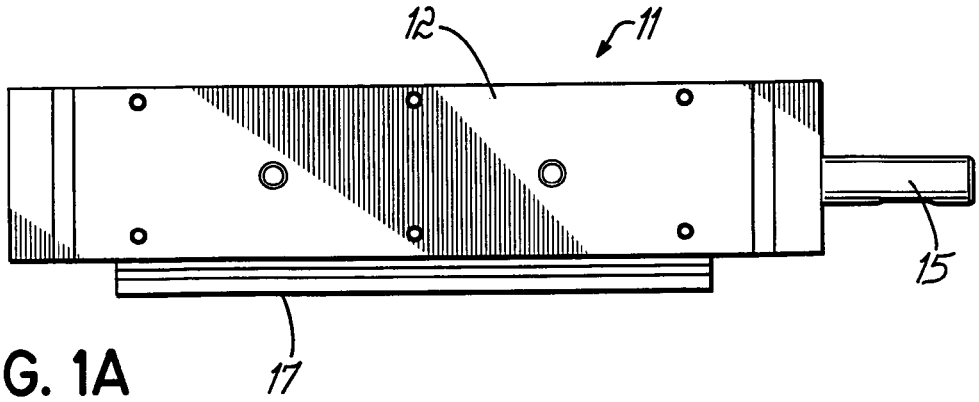
FIG. 1A is a side view of an applicator according to the invention in its entirety.
Figure 1B:
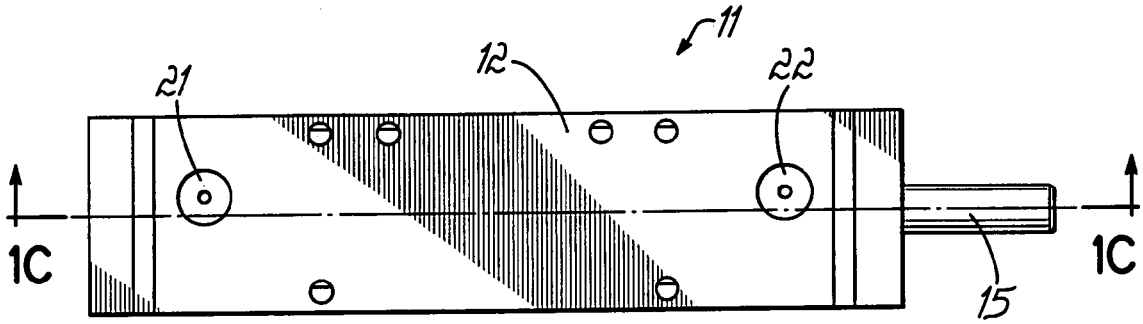
FIG. 1B is a top view of an applicator according to the invention in its entirety.
Figure 1C:
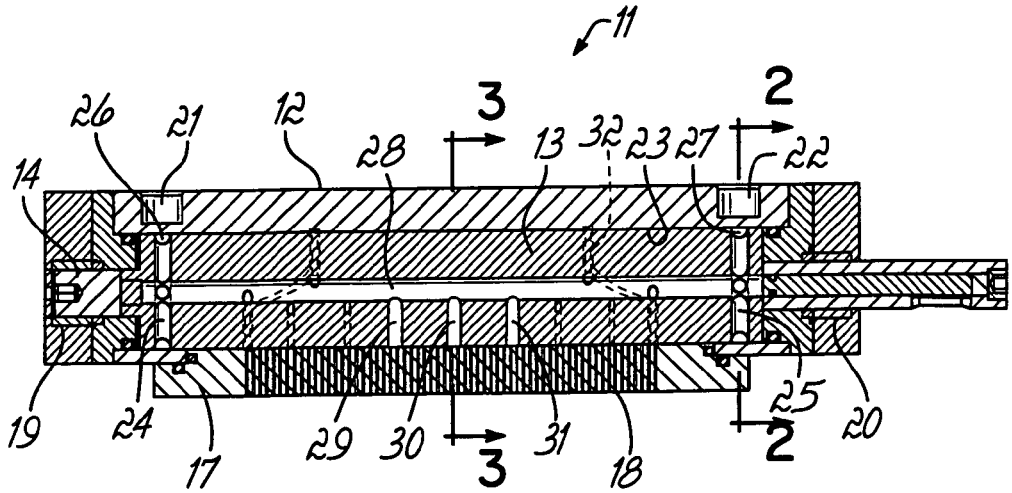
FIG. 1C is an orthogonal longitudinal cross section of an applicator according to the invention in its entirety.

FIGS. 1A, 1B, 1C shows an applicator 11 of oblong cubical shape. The following description applies to all illustrations in this figure. The multipart housing 12 of the applicator contains a drum gate 13 that can be rotatively driven via a pin 15 that protrudes from the housing. A nozzle block 17 is situated on the underside of the housing, wherein a portion of said nozzle block is inserted into the housing 12 in a fitted and sealed manner and in direct contact with the drum gate 13. A linear nozzle 18 consisting of a row of bores or dispensing outlets is arranged in the nozzle block 17. The drum gate 13 is supported in the housing by a first pin 14 and the aforementioned protruding pin 15. The pins 14, 15 respectively rotate in bearing sleeves 19, 20. Transverse bores 21, 22 situated in the housing serve for supplying the liquid medium to a cylindrical drum chamber 23, in which the drum gate is seated in an essentially gap-free fashion. The drum gate contains respective intersecting, radial supply bores 24, 25 in the planes of the transverse bores 21, 22, one of which is illustrated in the form of a section along 2-2. The outer ends of these intersecting bores are respectively connected to one another by peripheral grooves or annular channels 26, 27. The intersecting bores extend through a central inner cavity 28 in the drum gate 13. Liquid medium is continuously supplied to the central inner cavity 28 in the drum gate 13 via the peripheral grooves 26, 27 that constantly communicate with the transverse bores 21, 22 and via the intersecting bores 24, 25. The liquid medium is then delivered from the central inner cavity 28 to a surface channel 32 in the drum gate via a plurality of radial outlet bores in the drum gate, three (29, 30, 31) of which are indicated in the form of examples. This surface channel in the drum gate forms a closed curve and is described in greater detail further below. Defined regions of the linear nozzle 18, i.e., certain individual bores, are supplied with liquid medium via the surface channel 32 within such defined time intervals that the liquid medium can emerge from the linear nozzle within defined time intervals.

Figure 2:
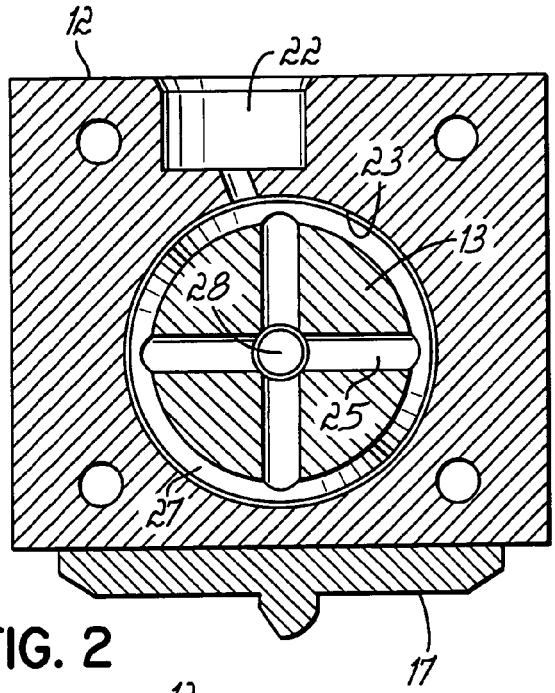
FIG. 2 is a cross sectional view of the applicator according to FIG. 1 taken along line 2-2 in FIG. 1C.

Section 2-2 according to FIG. 2 shows the housing 12 in the form of a block, the drum gate 13, and the nozzle block 17. This figure also shows the transverse bore 22 in the housing 12 that extends as far as the drum chamber 23 and is widened on the outside such that it forms a coupling sleeve. The intersecting bore 25, the peripheral groove 27 and the central inner cavity 28 are individually illustrated in the drum gate 13.

Figure 3:
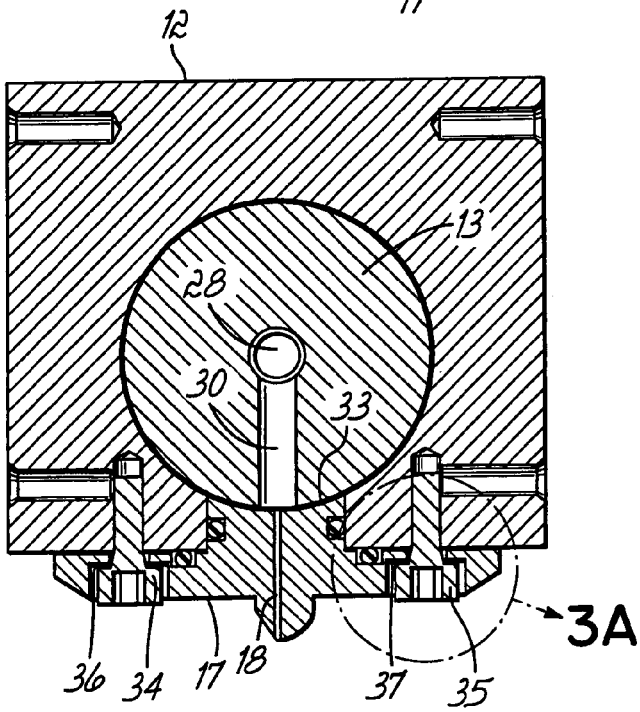
FIG. 3 is a cross sectional view of the applicator according to FIG. 1 taken along line 3-3 in FIG. 1C.
Figure 3A:
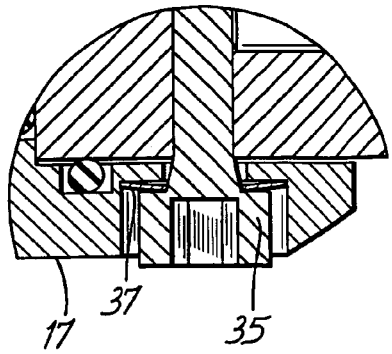
FIG. 3A is an enlarged detail of encircled area 3A shown in FIG. 3.
Figure 4A:
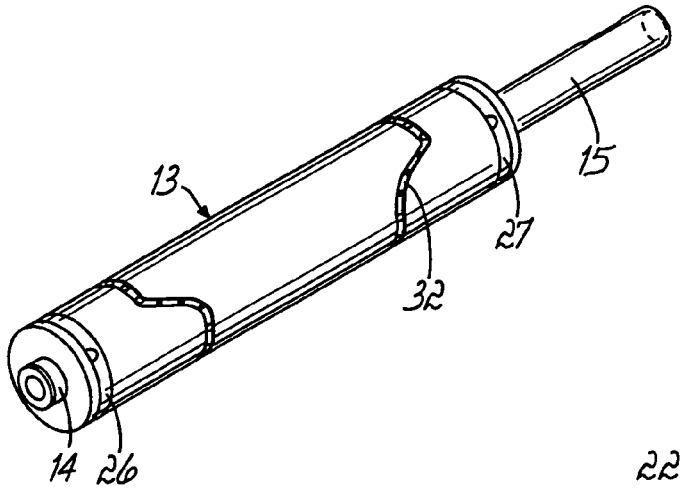
FIG. 4A is a perspective view of the drum gate.
Figure 4B:
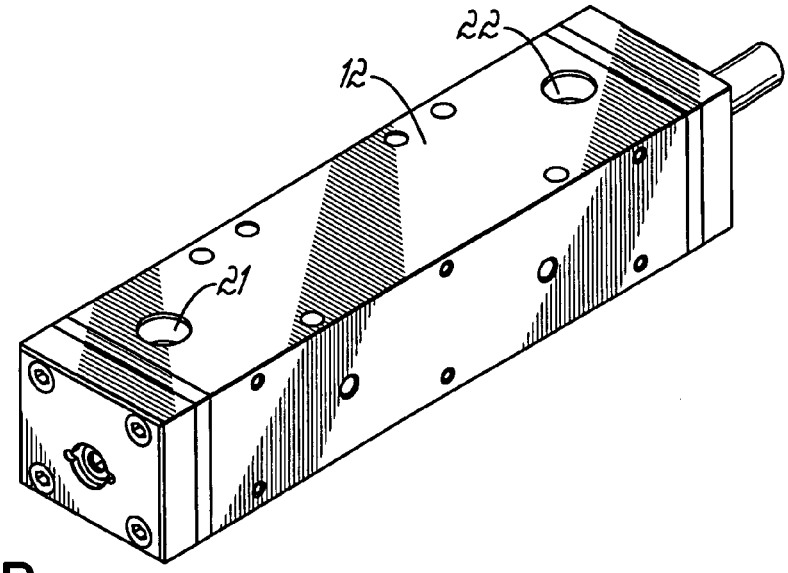
FIG. 4B is a perspective view of the entire applicator.
Figure 4C:
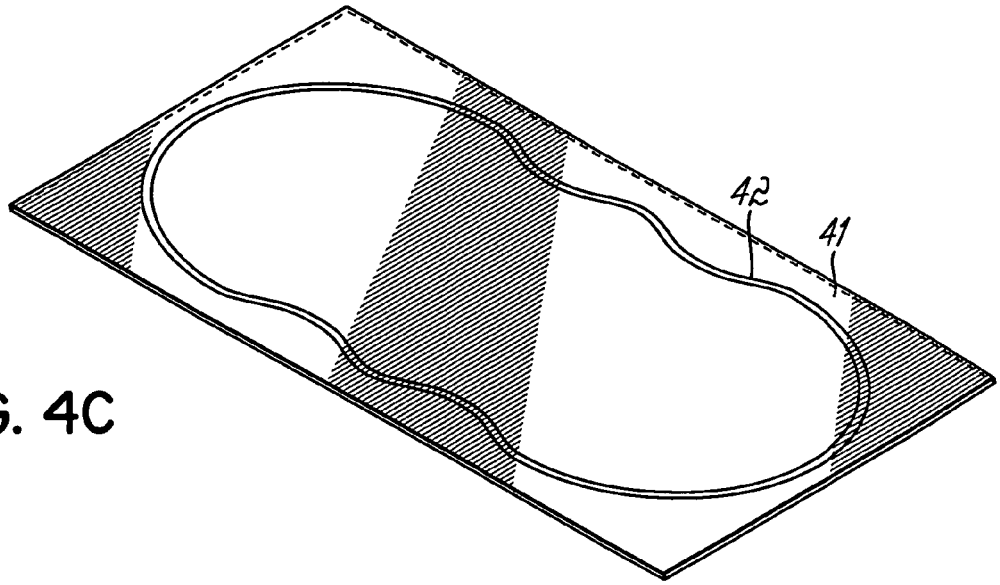
FIG. 4C is a perspective view of an applicator treated material strip.
Figure 5A:
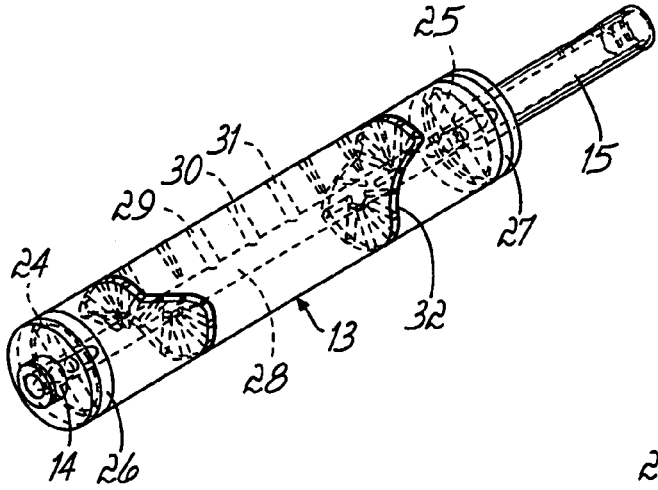
FIG. 5A is a perspective view of the drum gate with channel progressions shown with hidden lines.
Figure 5B:
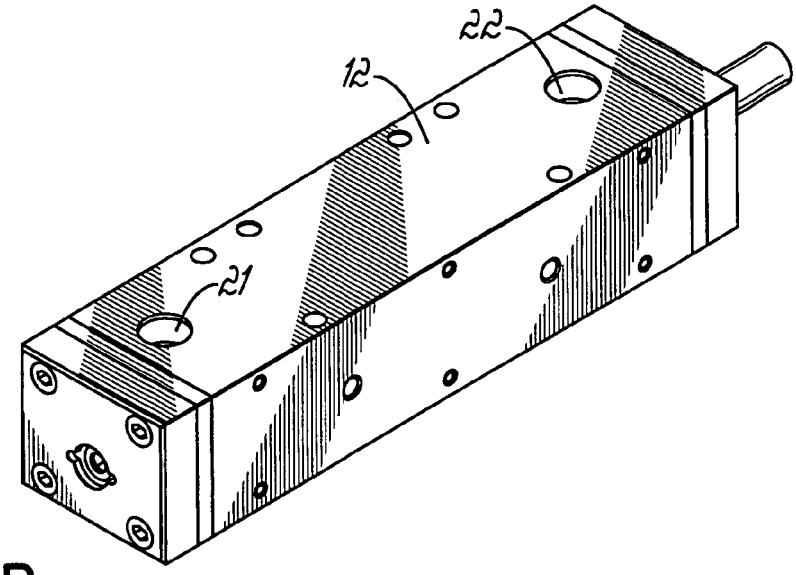
FIG. 5B is a perspective view of entire applicator.
Figure 5C:
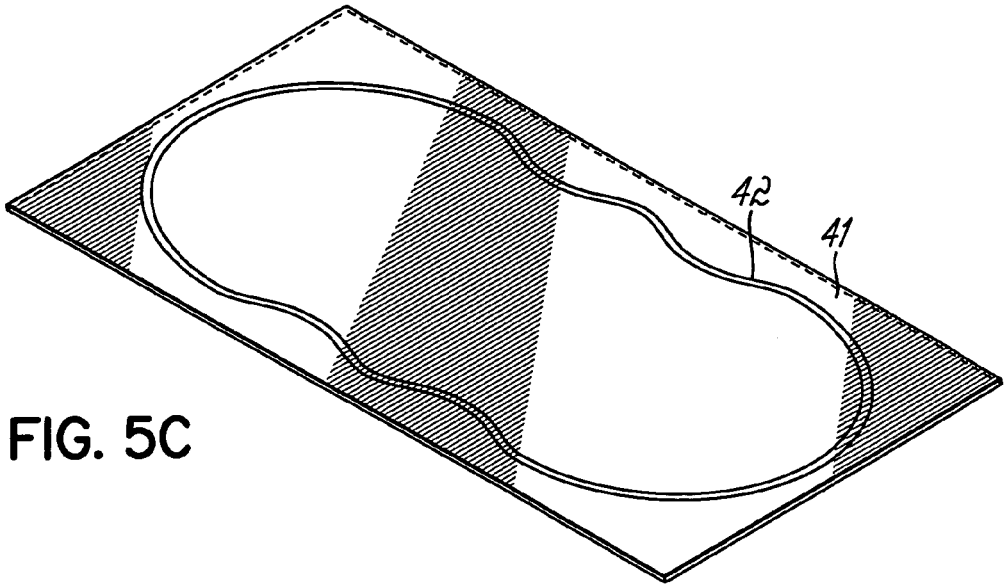
FIG. 5C is a perspective view of an applicator treated material strip.

The section 3-3 according to FIG. 3 shows the housing block 12 and the drum gate 13 with the central inner cavity 28 and one of the radial outlet bores 30 originating at this cavity. The radial bore 30 communicates with one of the individual bores of the linear nozzle 18. In the position shown, the liquid medium can be conveyed from the central inner cavity 28 to a certain section of the linear nozzle 18. The nozzle block 17 is fitted into an opening of the housing 12 where it is sealed several times. The nozzle block directly adjoins a portion of the drum gate 13 under prestress with a hollow cylindrical surface 33. In order to generate this prestress, the nozzle block 17 is held by screws 34, 35 and elastically supported relative to the housing 12 on the heads of these screws by means of disk springs 36, 37. This is illustrated particularly well in FIG. 3A.

The following description applies to FIGS. 4A through 5C. These figures show a detail of the drum gate 13 with its pins 14, 15 and the peripheral grooves 26, 27 in the region of the intersecting bores 24, 25. These figures also show the surface channel 32 that extends over the cylindrical surface of the drum gate 13 and forms a closed curve. When liquid medium is supplied via the transverse bores 21, 22, a rotation of the drum gate by 360° causes the medium to be applied to a material strip 41 transported perpendicularly to the drum gate in the form of a curve 42 that corresponds to a developed view of the peripheral groove 32. In this respect, the circumferential speed on the surface of the drum gate 13, ideally, is approximately equal to the transport speed of the material strip. The perspective view with hidden lines according to FIG. 5A also shows the intersecting bores 24, 25, the central channel 28, some of the radial bores 29, 30, 31 and the surface channel 32 that is supplied by all transverse bores.

The invention claimed is:

1. An applicator for applying liquid, comprising:

a housing having a drum chamber and a wall with an opening into said drum chamber;

a drum gate supported for rotation within said drum chamber, said drum gate having an outer cylindrical surface and a liquid outlet bore communicating with said outer cylindrical surface; and a nozzle spring-mounted to said housing over said opening, said nozzle having an inner surface adjacent said outer cylindrical surface of said drum gate and a plurality of dispensing outlets communicating with said opening and adapted to selectively communicate with said liquid outlet bore during rotation of said drum gate, wherein said inner surface of said nozzle is concave and shaped to cooperate with said outer cylindrical surface of said drum gate.

2. The applicator of claim 1, wherein said nozzle is spring-mounted to said housing by at least one screw and at least one spring, said screw having a body adapted to extend through said nozzle so as to be received in said housing and a head adapted to retain said nozzle, said spring being positioned between said head and said nozzle so as to spring bias said nozzle against said housing and said drum gate.

3. The applicator of claim 1, wherein said drum gate further includes an inner cavity adapted to receive the liquid and communicating with said liquid outlet bore, a surface channel in said outer cylindrical surface communicating with said liquid outlet bore and adapted to communicate with said nozzle as said drum gate rotates within said housing.

4. The applicator of claim 3, wherein said surface channel forms a closed curve pattern on said outer cylindrical surface of said drum gate.

5. The applicator of claim 4, wherein said drum gate further includes an annular channel formed in said outer cylindrical surface and a radial supply bore extending from said annular channel to said inner cavity, said annular channel adapted to communicate with said radial supply bore to supply the liquid to said inner cavity.

* * * * *